United States Patent [19]

Gostling

[11] 3,964,575

[45] June 22, 1976

[54] BUILDERS SCAFFOLDING

[75] Inventor: Peter Eric Gostling, Sutton Coldfield, England

[73] Assignee: C. Evans & Sons Limited, Gants Hill, Ilford, Great Britain

[22] Filed: Aug. 8, 1974

[21] Appl. No.: 495,890

[30] Foreign Application Priority Data

Aug. 13, 1973 United Kingdom ..... 38212/73

[52] U.S. Cl. ..... 182/230; 182/179; 248/188.4

[51] Int. Cl.[2] ..... E04G 5/02

[58] Field of Search ..... 182/178, 179; 52/695, 52/693, 637, 638; 248/221, 244, 216, 188.4, 188.2, 188.5

[56] References Cited

UNITED STATES PATENTS

| | | | |
|---|---|---|---|
| 1,955,074 | 4/1934 | Knupp | 182/178 |
| 2,043,498 | 6/1936 | Vecker | 52/695 |
| 3,190,405 | 6/1965 | Squire | 182/178 |
| 3,245,495 | 4/1966 | Wells | 248/235 |

FOREIGN PATENTS OR APPLICATIONS

| | | | |
|---|---|---|---|
| 1,380,910 | 10/1964 | France | 182/179 |

*Primary Examiner*—Reinaldo P. Machado
*Attorney, Agent, or Firm*—Melville, Strasser, Foster & Hoffman

[57] ABSTRACT

A standard for builders scaffolding having a head fitting for use in coupling two standards together in end-to-end relationship, said head fitting comprising a male adapter element, and a bracket member which is formed at its ends to engage and be fixed to the standard, said bracket also being formed with a projecting slot in which is received a wedge element which, in use, engages and retains in position the adjacent end of said two standards.

5 Claims, 3 Drawing Figures

Figure 1:
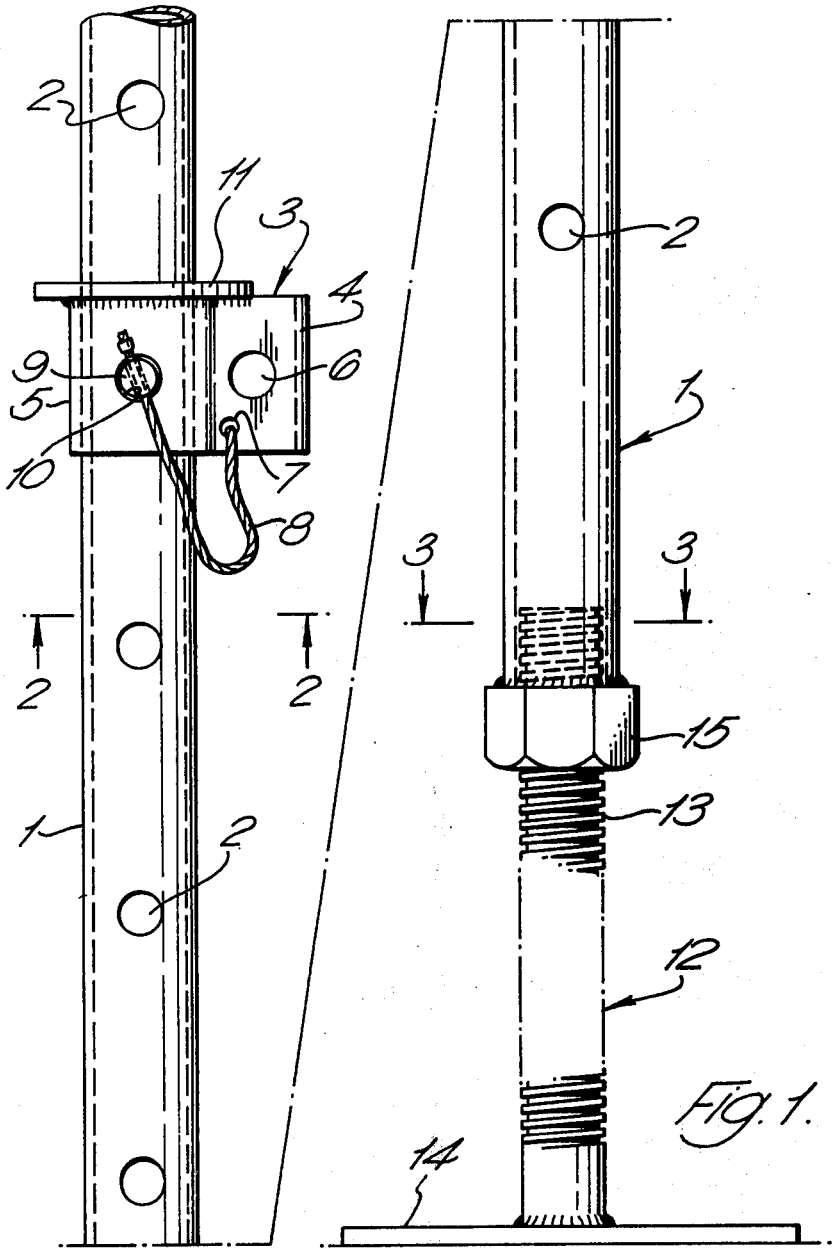

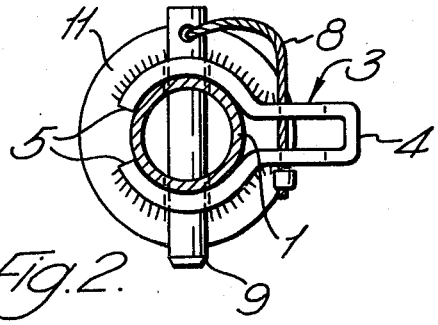
Fig. 2.
Fig. 3.
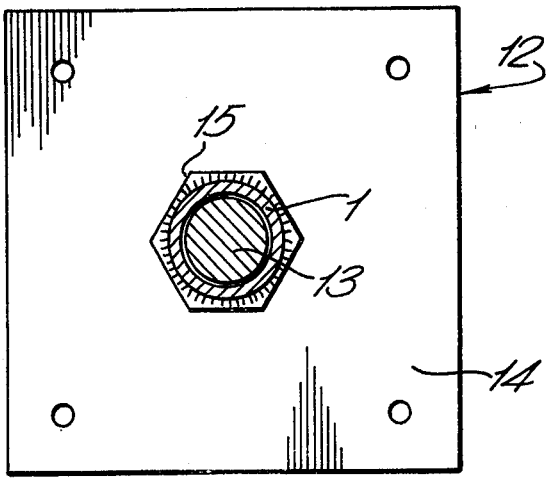

BUILDERS SCAFFOLDING

This invention relates to builders scaffolding of the kind comprising upright supports or standards, longitudinally extending bearers or ledgers and transversely extending bearers or transoms all of which are connected together to form a rigid structure.

The present invention is concerned with a base jack for the standards of such scaffolding.

Various forms of base jack are already known and serve the purpose of adjusting the heightwise positions of the standards in order primarily to obtain a level base for the scaffold structure. These known forms of base jack suffer from various disadvantages. Some comprise a method of adjustment which is extremely slow in operation, others have a quick action adjustment but incorporate a cross pin which is subjected to a considerable bending moment which reduces their carrying capacity, and all of them incorporate a forged internally threaded collar, which is not only expensive but is usually subject to prolonged delivery.

It is among the objects of the present invention to provide an improved base jack which has the minimum number of parts and is capable of carrying larger loads than prior art base jacks of a comparable size. Furthermore, the jack is such that it can be used with any normally used tubular standard or other tubular or part-tubular scaffold or like member.

According to the present invention, there is provided a base jack for the standards of a scaffold structure, which comprises a tube having a plurality of spaced transverse holes, a support bracket slidable lengthwise of the tube and having a transverse hole arranged to coincide with any one of the holes in the tube, a locking pin attached to the bracket and formed to pass through the coincident holes in the bracket and the tube, and a base plate attached to a screw-threaded rod which is in threaded engagement with one end of the tube, the other end of the tube being adapted telescopically to engage one end of a tubular standard or other tubular member, wherein the support bracket is in direct sliding engagement with the tube.

The invention is illustrated by way of example in the accompanying drawing in which, FIG. 1 is an elevation of a base jack according to the invention, FIG. 2 is a section on the line 2—2 of FIG. 1, and FIG. 3 is a section on the line 3—3 of FIG. 1.

Referring to the drawing, a base jack for the standards of a scaffold system comprises a main tube 1 having a plurality of spaced transverse holes 2.

Slidably mounted on the main tube 1 is a support bracket 3 in the form of a metal strip which is bent to present a box-like projection 4, the free ends 5 of the strip being of arcuate formation to closely fit around the main tube 1 as can be seen in FIG. 2.

The projection 4 is formed with a first transverse hole 6 to receive a tommy bar or the like, and with a second transverse hole 7 to receive one end of a flexible lead 8 the other end of which has attached thereto a locking pin 9. The free ends 5 of the bracket 3 are also formed with coincident transverse holes 10 which are positioned to coincide with the holes 2 in the main tube 1.

The support bracket 3 further includes a flat annular plate 11 the central hole of which is of corresponding diameter to that of the tube 1. The plate 11 is secured, as by welding, to the upper edge of the bracket 3.

A bearing plate device 12 consisting of a screw-threaded rod 13 and a transverse plate 14 secured thereto, is in screw-threaded engagement with the end of the main tube 1. The screw-thread of the tube 1 may be provided by a nut 15 fixed to the end of the tube 1, or it may be provided by screw-threading the inner peripheral surface of the tube 1.

In use, coarse adjustment is made by selecting the required hole 2 and then positioning the support bracket 3 adjacent the selected hole 2 and fixing it in position using the locking pin 9. A standard or other scaffold pole is then positioned over the upper end of the main tube 1 so that its end is in engagement with, and supported by, the annular plate 11.

When it is required to effect fine adjustment, a tommy bar or the like is inserted in the hole 6 and the bracket 3, together with the main tube 1, are turned in either direction relative to the rod 13 of the bearing plate device 12.

Thus, it will be seen that the present invention provides a quick-acting form of base jack which incorporates (a) a cross pin 9 which is virtually in direct shear thereby increasing its load bearing capacity, and (b) a collar 3 consisting of a steel pressing, such a pressing being relatively inexpensive and more readily obtainable than a forging. With regard to (a), the manner in which the cross pin 9 operates in conjunction with the pressed steel collar 3 provides a base jack having a much improved load carrying capacity. In this respect, in known jacks of this kind, a screw-threaded sleeve is provided between the collar, which is correspondingly threaded, and the main tube and a cross pin passes through the main tube, the sleeve and the collar. Therefore, it will be appreciated that the full weight of a scaffold structure is carried by the cross pin, via two diametrically opposite points on the circumferential edge of the collar. Due to the interposition of the screw-threaded sleeve in the prior art arrangement, as distinct from the arrangement of the present invention where the collar is in direct engagement with the main tube, it will be appreciated that the distance apart of the aforementioned bearing points on the cross pin is greater in the case of the prior art arrangement than it is in the arrangement of the present invention. Therefore, it is obvious that the bending movement to which the pin of the prior art arrangement is subjected is greater than that of the pin of the present invention with the result that the arrangement of the present invention is safer and can carry heavier loads.

Although the invention has been described with reference to a base jack, it will be understood that, without modification, it could also be used as a head jack. Furthermore, again without modification, the jack could be applied to a prop. In this respect, a length of tube having a bearing plate or other device at one end can be positioned over the upper free end of the main tube 1.

I claim:

1. A base jack for the standards of a scaffold structure, which comprises a tube having a plurality of spaced transverse holes, a support bracket slidable lengthwise of said tube and having a transverse hole arranged to coincide with any one of said holes in said tube, said support bracket comprising a metal strip which is shaped to present a box-like projection, the free ends of said strip being of arcuate formation to closely fit around said tube and to be fixed to said tube, a locking pin provided to extend through said coincident holes in said bracket and said tube, and a base plate supporting a screw-threaded rod which is in threaded engagement with one end of said tube, the other end of said tube being adapted telescopically to engage one end of a tubular standard or other tubular member, wherein said support bracket is in direct sliding engagement with said tube.

2. A base jack as claimed in claim 1, in which said box-like projection of said support bracket is formed with transverse holes to receive a tommy bar to facilitate turning of said bracket with said tube relative to said screw-threaded rod.

3. A base jack as claimed in claim 2, in which the uppermost edge of said bracket has fixed thereto an annular plate which provides a bearing surface for the end of said tubular standard.

4. A base jack as claimed in claim 3, in which the end of the tube has fixed thereto an internally screw-threaded nut to receive said screw-threaded rod.

5. A base jack as claimed in claim 3, in which said end of said tube is internally screw-threaded to receive said screw-threaded rod.

* * * * *